US006763691B1

(12) United States Patent
Rafferty

(10) Patent No.: US 6,763,691 B1
(45) Date of Patent: Jul. 20, 2004

(54) METER BOX LOCK ASSEMBLY

(75) Inventor: Robert E. Rafferty, Rutland, MA (US)

(73) Assignee: Inner-Tite Corporation, Holden, MA (US)

( * ) Notice: Subject to any disclaimer, the term of this patent is extended or adjusted under 35 U.S.C. 154(b) by 268 days.

(21) Appl. No.: 09/795,701

(22) Filed: Feb. 28, 2001

(51) Int. Cl.[7] ..... B65D 55/14
(52) U.S. Cl. ..... 70/164; 70/77; 70/232
(58) Field of Search ..... 109/1 R, 1 S, 109/23, 26, 31, 38, 48, 49.5, 50, 52, 54, 58.5, 59 R, 65; 269/53, 54.1, 76, 89, 41, 143, 249; 70/32–34, 63, 159–173, 77, 232, DIG. 34; 292/281, 288, 256, DIG. 11, 340, 341.18; 361/664–669

(56) References Cited

U.S. PATENT DOCUMENTS

| | | | | | |
|---|---|---|---|---|---|
| 1,053,328 | A | | 2/1913 | Suters | |
| 1,241,459 | A | * | 9/1917 | Woodard | 188/45 |
| 1,262,795 | A | * | 4/1918 | Holen | 269/221 |
| 1,343,851 | A | | 6/1920 | Roe | |
| 1,554,958 | A | | 9/1925 | Falk | |
| 2,121,386 | A | * | 6/1938 | Henrickson | 114/203 |
| 3,088,560 | A | | 5/1963 | Preuss | |
| 3,181,319 | A | | 5/1965 | Hudon | |
| 3,275,363 | A | * | 9/1966 | Bates et al. | 292/228 |
| 3,431,004 | A | | 3/1969 | Schell | |
| 3,867,822 | A | | 2/1975 | Morse et al. | |
| 3,938,839 | A | * | 2/1976 | Collier | 292/258 |
| 4,031,722 | A | | 6/1977 | Michelman et al. | |
| 4,080,811 | A | * | 3/1978 | Nielsen, Jr. | 70/164 |
| 4,096,718 | A | | 6/1978 | Michelman et al. | |
| 4,107,959 | A | * | 8/1978 | Sharzynski et al. | 70/159 |
| 4,120,182 | A | * | 10/1978 | Michelman et al. | 70/63 |
| 4,144,729 | A | * | 3/1979 | Nielsen, Jr. | 70/63 |
| 4,152,910 | A | * | 5/1979 | Swisher | 70/159 |
| 4,202,574 | A | * | 5/1980 | Redmayne | 292/228 |
| 4,254,647 | A | * | 3/1981 | Finck, Jr. | 70/77 |
| 4,326,395 | A | | 4/1982 | DeRosa | |
| 4,414,829 | A | * | 11/1983 | Nielsen, Jr. et al. | 70/160 |
| 4,475,365 | A | | 10/1984 | Swisher | |
| 4,551,999 | A | | 11/1985 | Guiler | |
| 4,986,096 | A | | 1/1991 | Soehner et al. | |
| 5,007,258 | A | * | 4/1991 | Mahaney | 70/159 |
| 5,315,849 | A | * | 5/1994 | Georgopoulos | 70/34 |
| 5,870,911 | A | | 2/1999 | DeWalch | |

* cited by examiner

*Primary Examiner*—Robert J. Sandy
*Assistant Examiner*—Ruth C. Rodriguez
(74) *Attorney, Agent, or Firm*—Gauthier & Connors

(57) ABSTRACT

A lock assembly for use in combination with an electric meter box or other like enclosure having a bottom, a side wall, and a cover which may be opened to gain access to the interior of the box, and which when closed, overlaps an upper edge of the side wall. The lock assembly includes a bracket having first and second mutually spaced flanges integrally joined by an intermediate web. A jaw is mechanically interengaged with and carried by the bracket for movement between its flanges. The bracket is configured for removable mounting on the side wall, with its intermediate web interposed between the cover and the upper edge of the side wall, and with the first flange and the jaw respectively located adjacent exterior and interior surfaces of the side wall. The jaw is urged towards the first flange to clamp the side wall therebetween, and a cap is secured to the bracket. The cap has a lip configured and dimensioned to overlap and maintain the cover in a closed position.

8 Claims, 5 Drawing Sheets

METER BOX LOCK ASSEMBLY

BACKGROUND OF THE INVENTION

1. Field of the Invention

This invention relates generally to electric meter boxes and other like utility: equipment enclosures, and is concerned in particular with an improved lock assembly for preventing unauthorized access to the interiors of such boxes.

2. Description of the Prior Art

It is known to provide lock assemblies with exterior caps having lips that overlap and thus prevent unauthorized opening of meter box covers. Many of those lock assemblies, such as for example those described in U.S. Pat. No. 4,107,959 (Skarzynski et al.); U.S. Pat. No. 4,120,182 (Michelman et al.); U.S. Pat. No. 4,144,729 (Nielsen); U.S. Pat. No. 4,475,365 (Swisher); and U.S. Pat. No. 5,315,849 (Georgopoulos) are fixed in place by means of bolts extending through holes in the side walls of the meter boxes. This complicates installation, requiring the use of hand tools to drill or punch out the required bolt holes, and requires workmen to reach into the box interiors to tighten the bolts during installation.

Other lock assemblies, such as those disclosed in U.S. Pat. Nos. 4,031,732 (Michelman et al.); U.S. Pat. No. 4,080,811 (Nielsen) and U.S. Pat. No. 4,096,718 (Michelman et al.) avoid piercing the meter box side walls, relying instead on mounting brackets that overlap the upper edges of the side walls and that are secured in place by retaining screws bearing directly against the interiors of the side walls. Experience has shown, however, that the retaining screws are vulnerable to being bent or frictionally dislodged when external components of the lock assemblies are hammered, pried or otherwise forced by those seeking to gain unauthorized access to the box interiors. The Mounting brackets are thus loosened and ultimately disengaged from the box side walls, resulting in failure of the lock assemblies.

Attempts to force the lock assemblies can also overly stress and thus defeat the barrel locks used to interconnect lock assembly components.

The objective of the present invention is to avoid the above-noted problems by providing an improved lock assembly that is easy to install without having to employ tools to drill, punch or otherwise breach the side wall of the meter box, and that once installed, is highly resistant to being dislodged or otherwise compromised by those seeking to gain unauthorized access to the box interior.

SUMMARY OF THE INVENTION

The lock assembly of the present invention is designed for use on an electric meter box or other like enclosure having a bottom wall, a side wall, and a cover that may be opened to gain access to the box interior, and that when closed, overlaps an upper edge of the side wall. The lock assembly includes a -mounting bracket having first and second mutually spaced flanges integrally joined by an intermediate web. A jaw is mechanically interengaged with and carried by the mounting bracket for movement between the first and second flanges. The bracket is configured and dimensioned for mounting on the side wall, with its intermediate web interposed between the cover and the upper edge of the side wall, and with its first flange and the movable jaw located respectively adjacent exterior and interior surfaces of the side wall. A manually adjustable device, for example a screw, is threaded through the second flange and serves to secure the bracket in place by urging the jaw towards the first flange to clamp the box side wall therebetween. A cap with a lip overlapping the cover coacts in interlocked engagement with the thus secured bracket.

These and other features and advantages of the present invention will now be described in greater detail with reference to the accompanying drawings, wherein:

DESCRIPTION OF PREFERRED EMBODIMENTS

Figure 1:
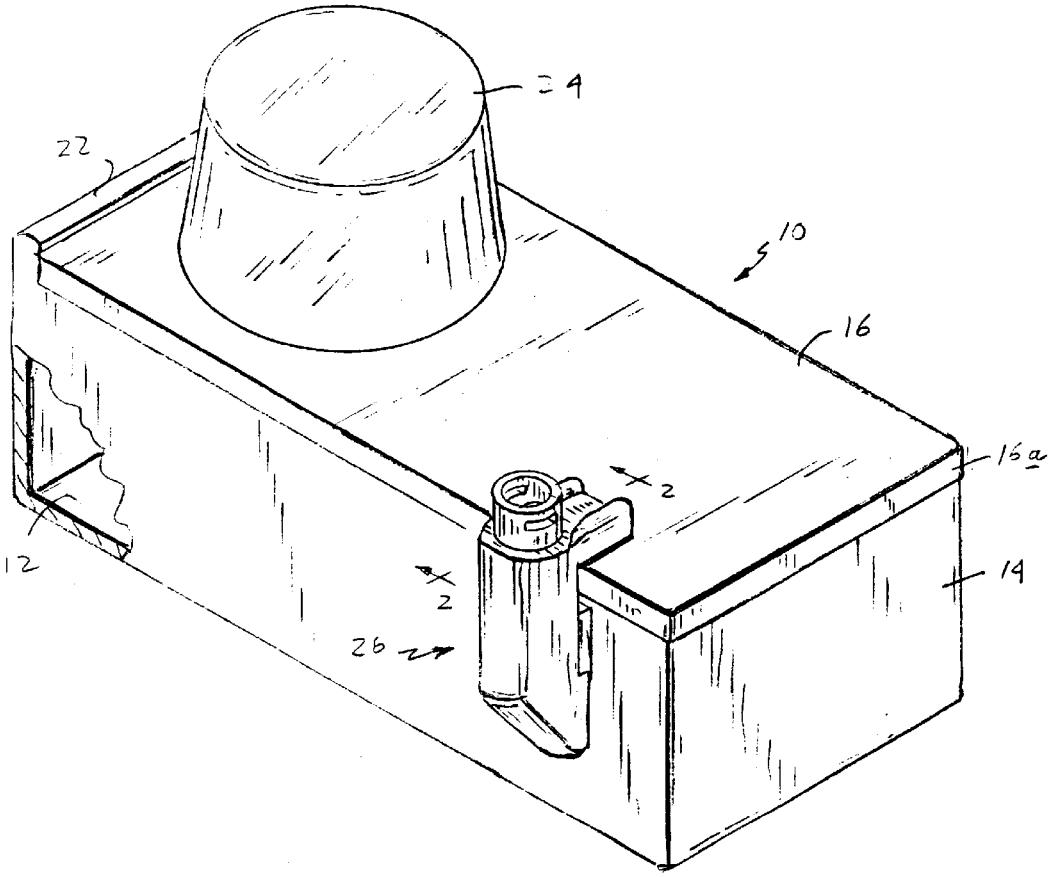
FIG. 1 is a perspective view, with portions broken away, of a conventional meter box employing a lock assembly in accordance with the present invention.
Figure 2:
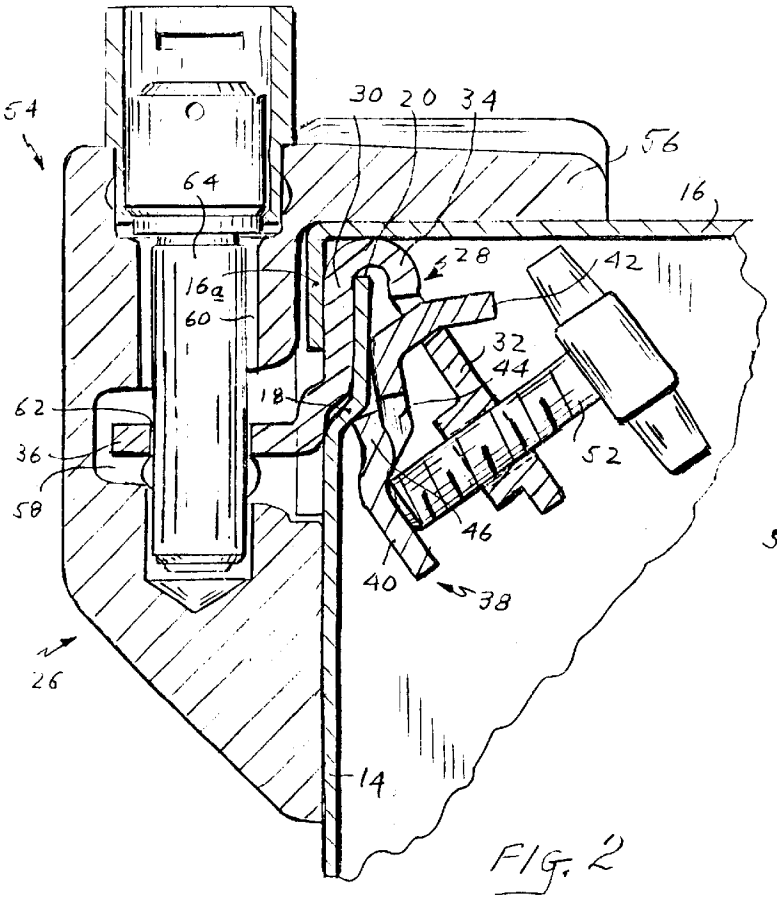
FIG. 2 is a sectional view on an enlarged scale taken along lines 2—2 of FIG. 1.

Referring initially to FIGS. 1 and 2, a conventional electric meter box is shown at 10. The meter box includes a bottom wall 12, a side wall 14, and a cover 16. The side wall has a stepped configuration defining an angled ledge 18 spaced beneath the upper edge 20. The rear edge of the cover is overlapped by and captured beneath a lip 22 formed integrally with the side wall. The box encloses an electric meter (not shown) having a glass dome 24 protruding through an opening in the cover. As can best be seen in FIG. 2, the cover 16 is dimensioned to overlap the upper edge 20 of the side wall 14, with a peripheral lip 16*a* arranged to surround the top edge when the cover is in its closed position. A lock assembly 26 in accordance with one embodiment of the present invention serves to retain the cover in its closed position.

Figure 3:
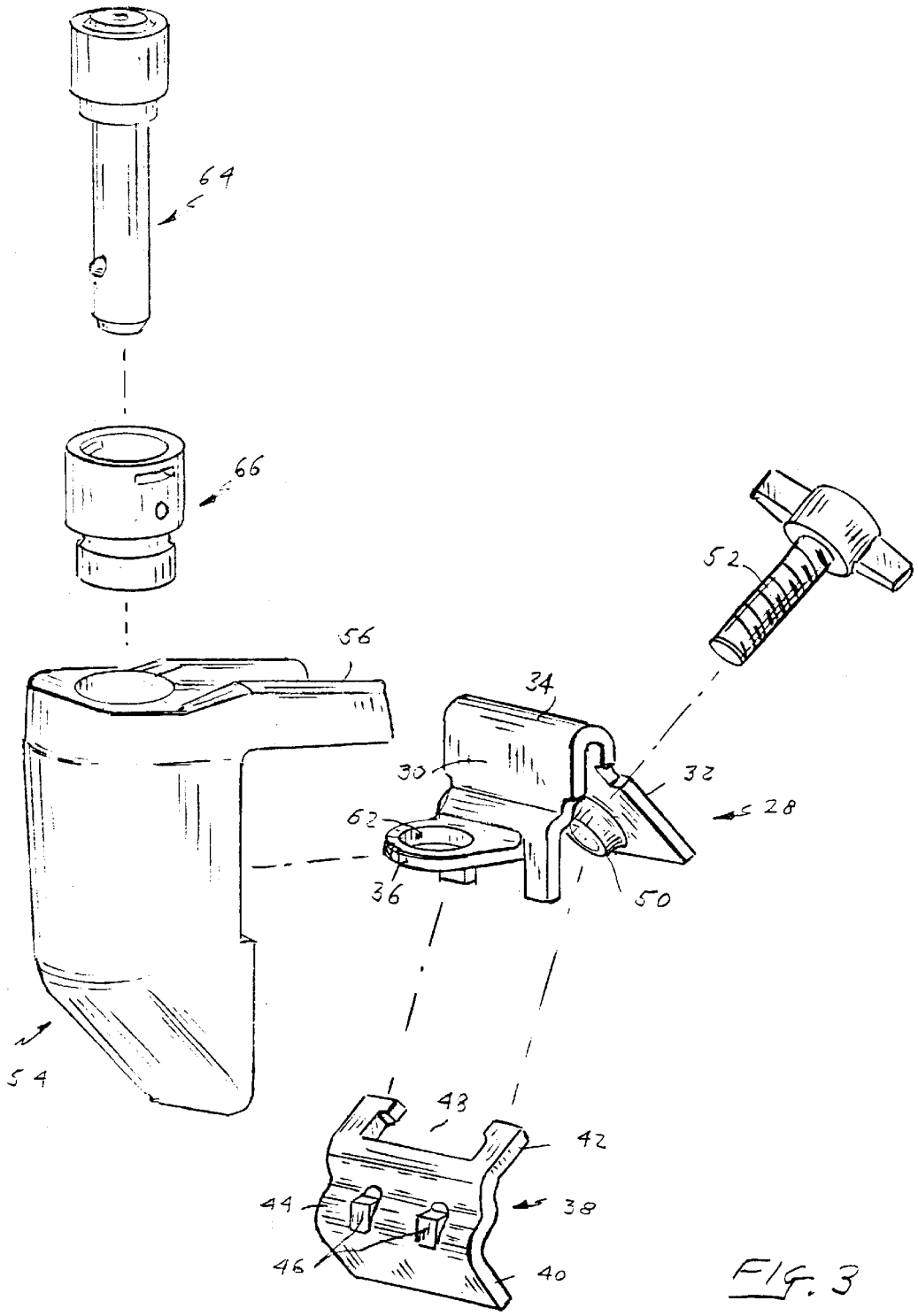
FIG. 3 is an exploded perspective view of the basic components making up the lock assembly shown in FIGS. 1 and 2.

With further reference to FIG. 3, it will be seen that the lock assembly includes a mounting bracket 28 having first and second mutually spaced and angularly disposed flanges 30, 32 integrally joined by an intermediate web 34. A third flange 36 is formed integrally with and projects laterally from the first flange 30.

A jaw 38 has a stepped cross sectional configuration with angularly disposed flanges 40, 42 joined by a web 44. Teeth 46 project from one side of the web 44, and the flange 42 is cut away as at 48 to provide arms configured to interengage mechanically with notches in the sides of the flange 32 on mounting bracket 28.

A threaded boss 50 on flange 32 of the mounting bracket 28 accepts a manually adjustable thumb screw 52. The bracket 28 is configured for mounting on the side wall 14 of the meter box 10, with the intermediate web 34 extending over the upper edge 20 of the side wall, and with the first flange 30 of the bracket and the jaw 38 respectively located adjacent exterior and interior surfaces of the side wall. By manually tightening the thumb screw 52, the jaw is pivoted in a clockwise direction (as viewed in FIG. 2), causing the teeth 46 to engage the interior surface of the side wall beneath the angled ledge 18. The side wall is thus securely clamped between the first bracket flange 30 and the jaw 38. The angled orientation of the second bracket flange 32 and the resulting upward projection of the thumb screw 52 makes it possible for bracket mounting to be accomplished without having to reach into the interior of the meter box.

After the mounting bracket 28 has been secured to the box side wall, the cover is closed. A cap 54 is then employed to maintain the cover in its closed position. The cap has an externally projecting integral lip 56 and an internal recess 58 extending horizontally across a vertical blind bore 60. The recess 58 is configured to receive the third flange 36 of the mounting bracket 28, with the blind bore 60 aligned with an aperture 62 in the third flange.

A conventional barrel lock 64 is received in the bore 60 and aligned aperture 62, thus serving to mechanically interlock the cap 54 to the third flange 36, with the lip 56 of the cap overlapping the box cover 16. Optionally, the upper end of the barrel lock may be recessed within a protective ferrule 66 received in an enlarged diameter upper end of the blind bore 60.

Figure 4:
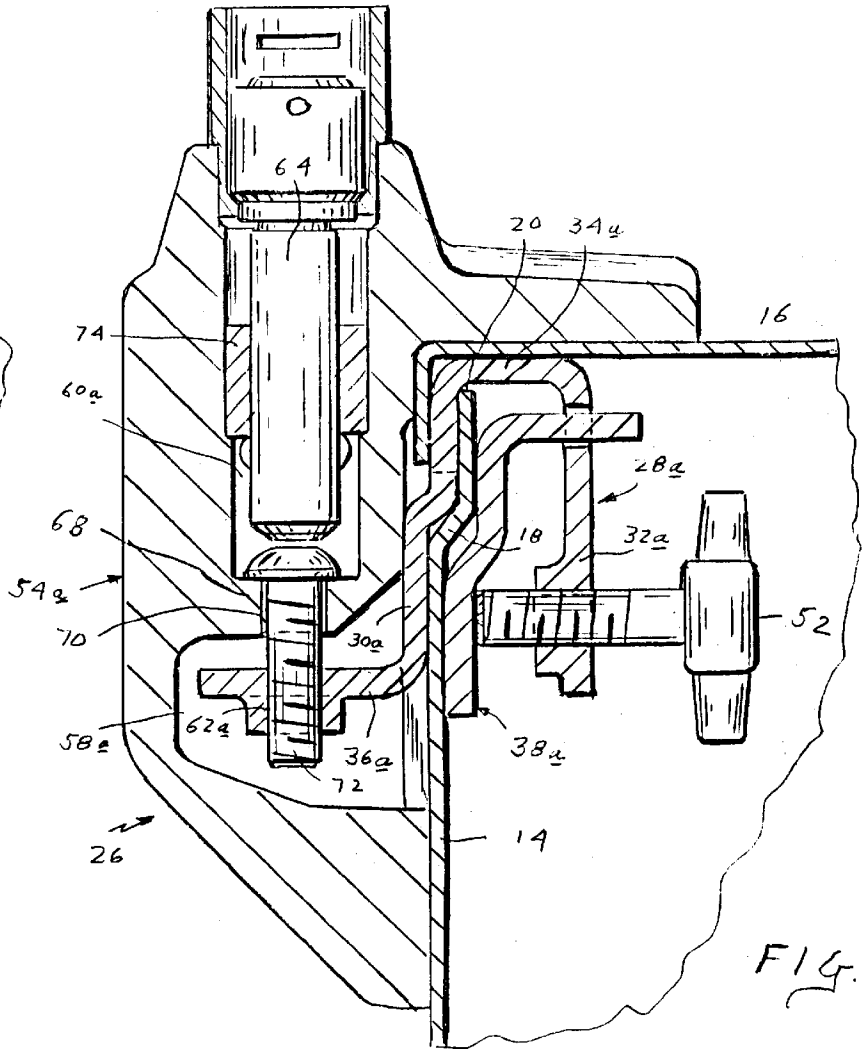
FIG. 4 is a sectional view similar to FIG. 2 showing an alternative embodiment of a lock assembly in accordance with the present invention.

In the alternative embodiment disclosed in FIG. 4, the mounting bracket: 28*a* again includes first and second flanges 30*a*, 32*a* joined by an intermediate web 34*a*. But here, the flanges 30*a*, 32*a* are arranged in parallel, resulting in the thumb screw 52 projecting horizontally into the box interior. Also, the jaw 38*a* is configured and arranged to be urged by the thumb screw 52 into horizontal sliding movement and into engagement with the interior surface of the box wall, again beneath the angled ledge 18.

The blind bore 60*a* of the cap 54*a* is separated from the recess 58*a* by an internal shelf 68 having an aperture 70 extending vertically therethrough. The aperture 70 is aligned with a threaded bore 62*a* in the third flange 36*a* of the bracket 28*a*, and a screw 72 extends through the shelf aperture 70 into threaded engagement with the threaded bore 62*a* in the third flange 36*a* to effect mechanical interengagement of the cap 54*a* with the mounting bracket 28*a*.

A sleeve 74 is secured, as for example by press fitting, into the vertical bore 60*a*. The sleeve cooperates with the barrel lock 64 to block access to the screw 72.

Figure 5B:
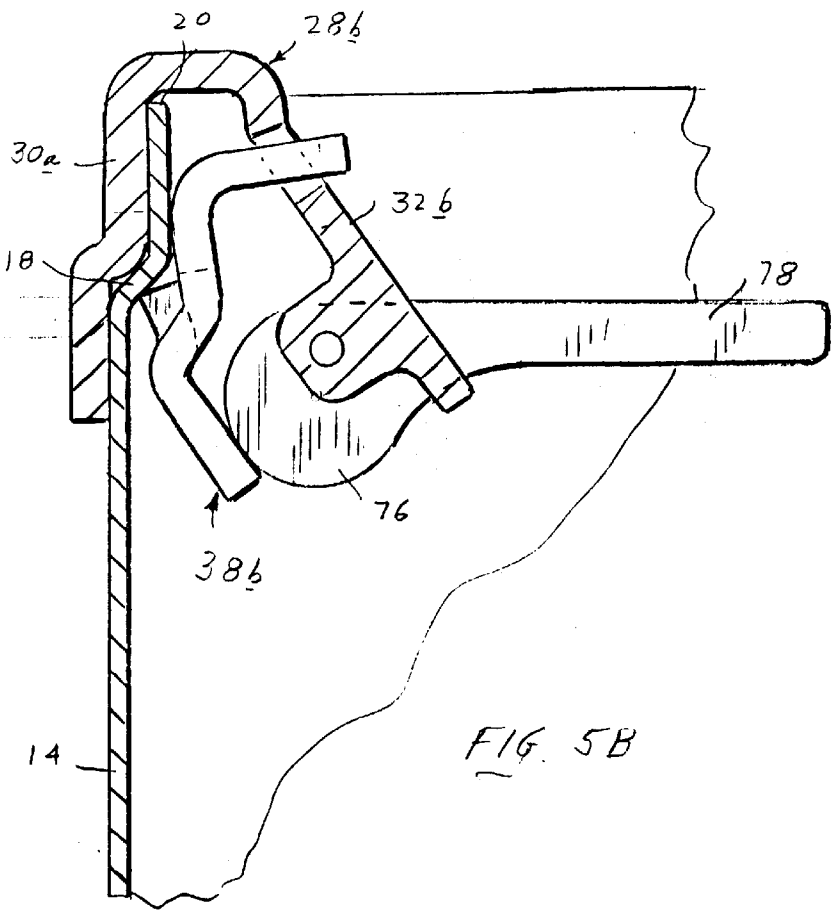
FIGS. 5A and 5B illustrate a further embodiment of a locking mechanism for securing the mounting bracket to the side wall of the meter box.
Figure 5A:
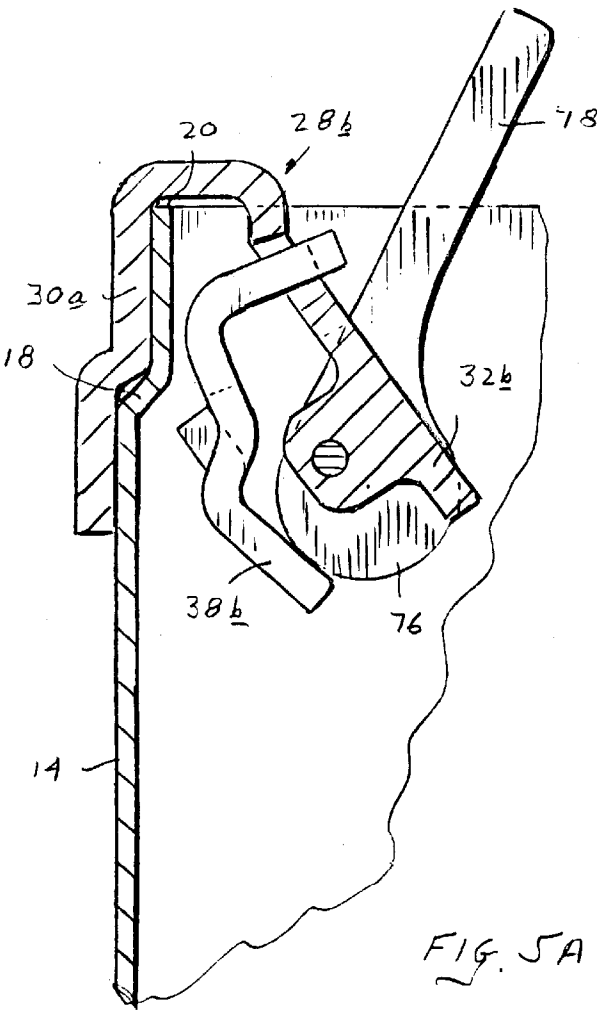

Force exerting means other than the thumb screws 52 shown in FIGS. 2–4 may be employed to urge the jaws 38, 38*a* against the interior surfaces of the box walls. For example, as shown in FIGS. 5A and 5B, the second flange 32*b* of the bracket 28*b* may be equipped with a rotatable cam 76 operated by means of a handle 78. When unlocked, as shown in FIG. 5A, the cam allows freedom of movement of the jaw 38*b* relative to the bracket flanges 30*a*, 32*b* to thereby accommodate mounting of the bracket on the box side wall.

The bracket may then be locked in place by depressing the handle 78, as shown in FIG. 5B, to rotate the cam 76 against the jaw 38*b*, thus urging the jaw into its locked position.

Figure 6B:
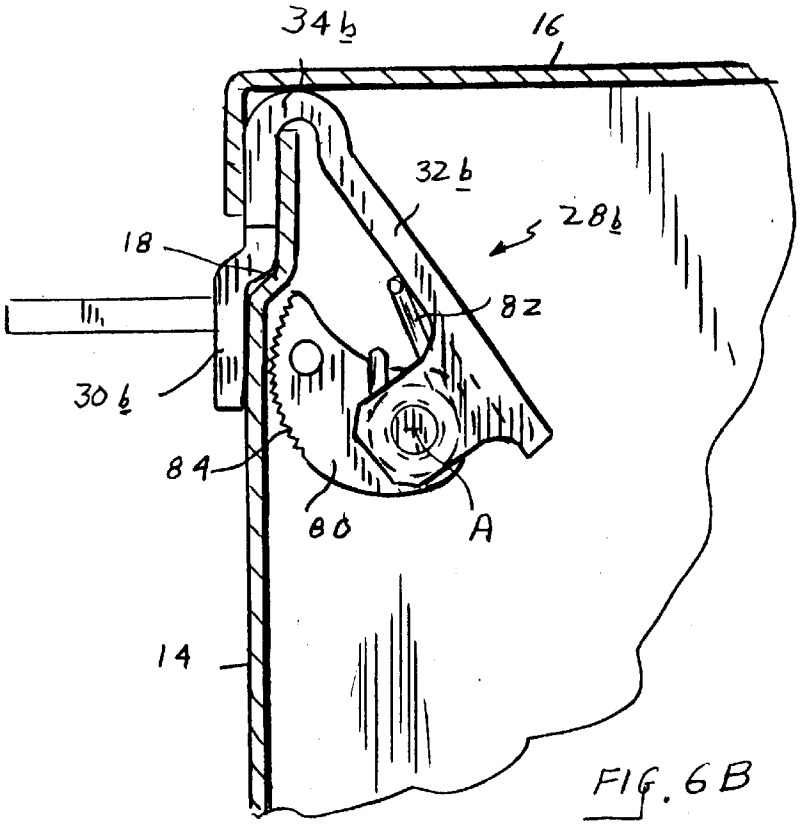
FIGS. 6A and 6B are views similar to FIGS. 5A and 5B showing still another embodiment of a locking mechanism for the mounting bracket.
Figure 6A:
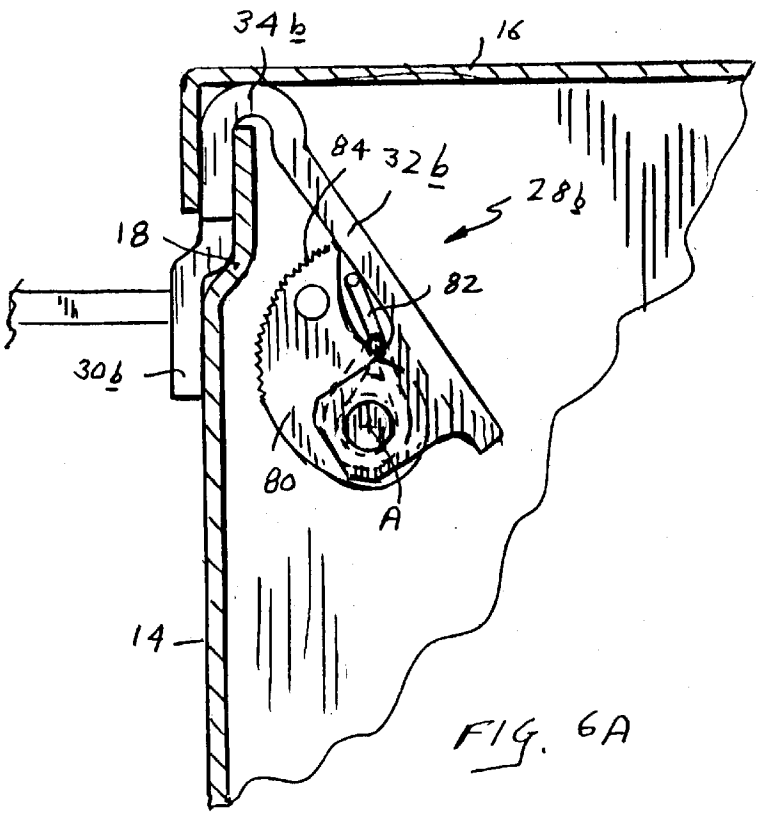

In the embodiment shown in FIGS. 6A and 6B, the mounting bracket 28*b* also includes first and second flanges 30*b*, 32*b* joined by an intermediate web 34*b*. Flange 32*b* carries a cam 80 rotatable about an axis "A". A force exerting means in the form of a spring 82 resiliently urges the cam to rotate in a counterclockwise direction. In FIG. 6A, the cam has been rotated in a clockwise direction against the biasing action of the spring and into an open position to accommodate mounting of the bracket on the side wall 14 of the meter box. In FIG. 6B, the cam has been released, and the biasing action of the spring has caused the cam to rotate in a counterclockwise direction, bringing the toothed periphery 84 of the cam into engagement with the interior surface of the box side wall 14 beneath the angled ledge 18.

In light of the foregoing, it will now be appreciated by those skilled in the art that the present invention offers a number of significant advantages as compared to known prior art lock assemblies.

For example, the lock assembly may be installed without having to drill, punch or otherwise breach the side wall of the meter box. Installation can be readily accomplished without having to employ tools such as drills, punches and the like.

The interposition of a movable jaw between the interior box side wall and the force exerting means (thumb screw 52, cams 76, 80 or the like) insures that the force exerting means is safeguarded from being bent or frictionally dislodged by stresses resulting from attempts to defeat the lock assembly by hammering, prying or otherwise forcing the external cap. Such stresses are absorbed by the external cap and the mounting bracket, leaving the barrel lock largely unaffected.

I claim:

1. For use in combination with a utility box having a bottom, a side wall, and a cover which may be opened to gain access to the interior of the box, and which when closed, overlaps an upper edge of the side wall, a lock assembly for maintaining the cover in its closed position, said lock assembly comprising:

a bracket having first and second mutually spaced flanges integrally joined by an intermediate web;

a jaw mechanically interengaged with and carried by said bracket for movement between said first and second flanges, said bracket being configured for removable mounting on said side wall, with said intermediate web interposed between said cover and the upper edge of said side wall, and with said first flange and said jaw respectively located adjacent exterior and interior surfaces of said side wall;

force exerting means for urging said jaw towards said first flange to thereby clamp said side wall therebetween;

a cap having a lip configured and dimensioned to overlap said cover; and interlocking means for securing said cap to said bracket.

2. The lock assembly of claim 1 wherein the side wall of said box is provided with an interior ledge spaced below said upper edge, and wherein said jaw engages said side wall beneath said ledge.

3. The lock assembly of claims 1 or 2 wherein said jaw includes at least one tooth engageable with said side wall.

4. The lock assembly of claim 1 wherein said force exerting means comprises a screw threaded through said second flange.

5. The lock assembly of claim 4 wherein said jaw includes a plurality of teeth engageable with said side wall.

6. The lock assembly of claim 1 wherein said jaw is pivotally connected to said second flange.

7. The lock assembly as claimed in claim 1 wherein said second flange is inclined at an acute angle with respect to said first flange.

8. The lock assembly as claimed in claim 1 wherein said bracket is provided with a third flange projecting from said first flange, and wherein said interlocking means engages said third flange.

* * * * *